US006817845B2

(12) United States Patent
Angle et al.

(10) Patent No.: US 6,817,845 B2
(45) Date of Patent: Nov. 16, 2004

(54) CENTRIFUGAL PUMP WITH SWITCHED RELUCTANCE MOTOR DRIVE

(75) Inventors: Thomas L. Angle, Suisun, CA (US); Steven D. Osborn, Sandy, UT (US)

(73) Assignee: EnviroTech Pumpsystems, Inc., Salt Lake City, UT (US)

( * ) Notice: Subject to any disclaimer, the term of this patent is extended or adjusted under 35 U.S.C. 154(b) by 0 days.

(21) Appl. No.: 10/126,720

(22) Filed: Apr. 19, 2002

(65) Prior Publication Data

US 2003/0198563 A1 Oct. 23, 2003

(51) Int. Cl.[7] ..... F04B 35/04
(52) U.S. Cl. ..... 417/423.7; 417/423.14
(58) Field of Search ..... 417/423.7, 423.14, 417/410.3, 410.4, 350, 351; 415/88, 89, 17, 172 R; 310/268

(56) References Cited

U.S. PATENT DOCUMENTS

| | | | | | |
|---|---|---|---|---|---|
| 3,932,069 | A | * | 1/1976 | Giardini et al. | 417/420 |
| 3,977,810 | A | * | 8/1976 | Erickson et al. | 415/89 |
| 4,252,499 | A | * | 2/1981 | Erickson | 415/52 |
| 4,280,790 | A | * | 7/1981 | Crichlow | 415/89 |
| 4,659,452 | A | * | 4/1987 | Howell | 361/31 |
| 5,128,576 | A | * | 7/1992 | Obradovic | 310/217 |
| 5,246,349 | A | | 9/1993 | Hartog | 417/371 |
| 5,261,784 | A | * | 11/1993 | Weber | 415/88 |
| 5,649,811 | A | | 7/1997 | Krol, Jr. et al. | 417/353 |
| 5,659,452 | A | * | 8/1997 | Blackburn | 361/31 |
| 6,053,705 | A | | 4/2000 | Schob et al. | 417/53 |
| 6,056,518 | A | | 5/2000 | Allen et al. | 417/355 |
| 6,193,473 | B1 | * | 2/2001 | Mruk et al. | 417/350 |
| 6,247,906 | B1 | | 6/2001 | Pijanowski | 417/410.4 |
| 6,254,361 | B1 | * | 7/2001 | Sabini | 417/423.14 |
| 6,369,470 | B1 | * | 4/2002 | Kylander et al. | 310/52 |

FOREIGN PATENT DOCUMENTS

JP 10-288191 * 10/1998

OTHER PUBLICATIONS

SUNFLO© High–Pressure Centrifugal Pumps from Sundstrand Fluid Handling Corporation, 1998, p. 4.*

SUNFLO© *High–Pressure Centrifugal Pumps*from Sundstrand Fluid Handling.*

* cited by examiner

*Primary Examiner*—Charles G. Freay
(74) *Attorney, Agent, or Firm*—Morriss O'Bryant Compagni, P.C.

(57) ABSTRACT

A centrifugal pump, particularly of the pitot tube type, is specifically configured and coupled with a switched reluctance motor to provide improved pumping characteristics and economical operating advantages in the pump assembly, including the ability to rapidly decrease pump speed (e.g., from 100% to 10%) in a matter of seconds (i.e., three to six seconds) and, likewise, to rapidly increase (e.g., zero percent to 80% or greater) in a matter seconds (i.e., five to ten seconds), despite the larger mass and inertia characteristics of some centrifugal pumps. The pump assembly of the present invention is also configured to provide a smaller footprint, thereby rendering the pump more suitable to a wider variety of applications than has been previously available to conventional pitot tube pumps. The pump assembly of the present invention is more economical to manufacture and use.

20 Claims, 3 Drawing Sheets

CENTRIFUGAL PUMP WITH SWITCHED RELUCTANCE MOTOR DRIVE

BACKGROUND OF THE INVENTION

1. Field of the Invention

This invention relates to centrifugal pumps, and specifically relates to centrifugal pumps of the pitot tube type which are structured to provide operational and economical advantages over conventional high-speed centrifugal pumps.

2. Description of Related Art

Centrifugal pumps are used in a variety of industries to process fluids or liquid/solid mixtures. The speed at which a centrifugal pump operates varies widely between types and manufactures of pumps, and the speed at which any given pump is operated is dependent on the particular application in which the pump is used. Each application dictates the particular pumping requirements, and thus the particular characteristics (pump speed, pump size, cost to operate) that the pump must have to suit the given application.

For example, in certain applications it may be necessary or desirable to rapidly decrease the pump speed capacity of the pump from 100% to, say, 10% in a matter of a few seconds. Conversely, it may also be desirable to rapidly increase the pump speed capacity of the centrifugal pump from, say, zero percent to 80% or greater in a matter of a few seconds. In other applications, for example, the space available for placement of the pump at a job site may be very limited and will require a pump with a smaller footprint. And in most applications, the user of the pump is desirous of employing the most cost-effective pump system for the particular project.

These application requirements, as well as other requirements, have been addressed in the past by using conventional centrifugal pumps coupled with standard induction motors. Centrifugal pumps of the pitot tube type, however, have not been found economically and operationally suitable for some applications because pitot tube pumps have size, weight and inertia characteristics which rendered them less desirous, despite the fact that pitot tube pumps have pumping characteristics and efficiencies that make them highly suited to various industrial pumping applications.

By way of example, the rotational speed of conventional high-speed centrifugal pumps is better able to be rapidly increased or decreased because of the construction of such pumps. That is, the rotating assembly of a high-speed centrifugal pump comprises a small drive shaft and small impeller. Thus, the rotating mass and inertia of the rotating elements of a high-speed centrifugal pump are relatively low, and the speed of rotation of the elements can be rapidly increased or decreased as a result.

Centrifugal pumps of the pitot tube type, however, differ from conventional centrifugal pumps in that they have a rotor, driven by a drive shaft, which rotates about a stationery pitot tube. The pitot tube is positioned, and operates, to receive and move fluid from the pump at high velocity. Pitot tube pumps differ further from conventional centrifugal pumps in that the rotating assembly, comprising a rotor, rotor cover and drive shaft, is considerably greater in weight than the rotating elements of a conventional centrifugal pump of a similar pumping capacity. For example, the weight of the rotating elements of a conventional high-speed centrifugal pump may be twenty-five pounds while the rotating assembly of a comparably-sized pitot tube pump is four hundred pounds. The inertia in a pitot tube pump is likewise significantly greater than a high-speed centrifugal pump.

Systems with pitot tube pumps can be made to function in a manner which mimic high-speed centrifugal pumps in terms of their ability to rapidly change pump speed and, hence, pump capacity by adding valving systems which radically modify the flow of fluid from the pump within a very short period of time (e.g. four seconds). However, such modifications and means of rapidly increasing or decreasing the flow in a pitot tube pump are expensive.

A related problem inherent in pitot tube pumps is the fact that they require a greater amount of space, or they present a larger footprint, than high-speed centrifugal pumps. Pitot tube pumps are usually coupled with an induction motor and have a gear box positioned there between making the overall length of the pump, gear box and induction motor as much as ten feet long. By contrast, conventional high-speed centrifugal pumps powered by induction motors may be less than half the length of the pitot tube pump assemblage.

Another problem which is inherent in both pitot tube pump/induction motor assemblages and some high-speed centrifugal pump/induction motor assemblages is the need to align the drive shaft of the motor to the gear box, when used, and/or to the rotor or impeller shaft of the pump. The alignments are made by a technician in the field, which requires considerable time and expense to complete. Eliminating the need for alignment of the motor to a gear box and/or to the pump in an assemblage produces a significant operational cost advantage.

Further, while pitot tube pumps may be coupled directly to the housing of an induction motor and the rotor assembly coupled to the drive shaft, such arrangements present operating limitations. Principally, the drive shaft of an induction motor is small in diameter and, when coupled to a pitot tube rotor assembly, is required to support the large weight of the rotating assembly. As a result, the pump cannot be operated at high speeds, and low speeds must be maintained in order to avoid the occurrence of natural frequency vibration. Also, standard induction motors are not built with a bearing system that will accommodate the full range of thrust loading that a pitot tube pump applies to the drive shaft. Thus, a limitation is placed on the suction pressure that a pitot tube pump can handle and still have an adequate bearing life.

The problems identified above, which limit pitot tube pumps from being used in a number of pumping applications, may be solved by providing a pitot tube pump assembly where the pump is configured for connection to a motor that will provide the pitot tube pump assembly with the same or similar operational characteristics or advantages that are enjoyed by conventional centrifugal pumps coupled with standard induction motors, such as rapid modification of pump speed, a smaller footprint and/or significantly lowered operational costs.

BRIEF SUMMARY OF THE INVENTION

In accordance with the present invention, a centrifugal pump, particularly of the pitot tube type, is configured for connection to a switched reluctance motor to produce a pump assembly that has improved pumping characteristics and operational advantages, thus rendering the inventive pump assembly suitable for use in applications where a conventional centrifugal pump and standard induction motor have previously been used. The improved characteristics and operational advantages of the present invention include the capability of providing rapid increase or decrease in the speed of the pump and providing a more compact footprint as compared to conventional pitot tube pump assemblages or centrifugal pump assemblages which employ a standard induction motor. The present invention also provides operational cost advantages over prior pump systems in being smaller and easier to install and operate, thereby rendering the inventive pitot tube pump more economical to manufacture and use.

The pump assembly of the present invention is particularly modified from the conventional configuration of a pitot tube pump to enable the direct attachment of the pump's rotating assembly to the drive shaft of a switched reluctance motor. As described further hereinafter, the digital signal processing capabilities and configuration of switched reluctance motors make them particularly suitable for use with pitot tube pumps in view of the greater weight and higher inertia characteristics of pitot tube pumps, as compared with centrifugal pumps, particularly of the high-speed variety.

The rotating assembly of a pitot tube pump, comprising a rotor, rotor cover and shaft, is a considerably larger mass than the impeller of a high-speed centrifugal pump and often has a weight greater than 50 pounds (averaging 135 pounds or greater) and a rotating inertia greater than five pounds-foot$^2$ (averaging 15 pounds-foot$^2$ or greater). The mass and inertia of any given pump varies widely between types, sizes and manufactures of pumps. However, as a point of reference, a sixteen inch pitot tube pump may have a rotating mass of about 310 pounds and a rotating inertia of about 74 pounds-foot$^2$. By comparison, the rotating assembly (i.e., impeller and shaft) of a typical high-speed centrifugal pump of the same pumping capacity has a rotating mass and inertia that are an order of magnitude less than the pitot tube pump. Therefore, to produce rapid changes in pump speed requires a suitable motor.

By "rapid changes in pump speed" is meant that the pump speed capacity may be increased, for example, from zero percent capacity to eighty percent capacity or greater, or the pump speed capacity decreased, for example, from 100% to ten percent, or less, in a matter of seconds (i.e., between three to six seconds).

Standard induction motors and variable frequency drive motors are capable of producing rapid changes in pump speed in pumps having a smaller rotating mass and lower inertia. But the use of such motors with pitot tube pumps is economically unsuitable for producing quick changes in pump speed due to the greater mass and higher inertia of the rotating assembly.

Additionally, standard induction motors can be connected directly to the impeller of a conventional centrifugal pump to effect the desired rapid change in pump speed, but a similar direct attachment of the rotating assembly of a pitot tube pump to the drive shaft of a standard induction motor introduces certain limitations to operation of the pump. Standard induction motors are manufactured with a smaller drive shaft because the drive shaft is typically not intended to support a large mass at the end. Placing a large-mass rotating assembly of a pitot tube pump on the small drive shaft of an induction motor causes certain natural frequency vibrations that must be avoided. Therefore, the pump must be operated at lower speeds than may be necessary or desired.

Standard induction motors are also not built with a bearing system that is adequate to accommodate a full range of thrust loading that the rotating assembly applies to the drive shaft. The suction pressure that the pump can handle is therefore necessarily limited to maintain an adequate bearing life on the motor.

Using a switched reluctance motor in direct attachment to the rotating assembly of a pitot tube pump solves many of the aforementioned problems. The operational features of switched reluctance motors are known, but it is the ability of switched reluctance motors to electronically control the magnetic field, in concert with the ability to specifically configure switched reluctance motors to fit the operational requirements of the pump, which render a switched reluctance motor particularly suitable for use with pitot tube pumps to produce rapid changes in the pump speed.

The drive shaft dimensions of a switched reluctance motor can be modified to accommodate the particular mass of a pitot tube rotating assembly (i.e., the rotating assembly can vary significantly in size and mass), thereby allowing the drive shaft to be directly coupled to the rotating assembly and eliminating the operating limitations imposed by standard induction motors. The ability to accommodate the drive shaft of the switched reluctance motor to the pump's mass requirements also eliminates suction pressure limitations and allows the bearings to be designed to the pump's requirements.

The connection of the pump directly to the drive shaft of the motor eliminates the need for a gear box, which presents a significant cost savings, and thus eliminates the need for precision alignment of the pump shaft to the gear box shaft and to the drive shaft of the motor, which also presents another significant cost savings over conventional pitot tube arrangements. The ability to eliminate the gear box further allows the inventive pump assembly to have a significantly smaller footprint than conventional pitot tube pump/motor/gearbox assemblages. Elimination of the gear box also reduces the inertia of the system and enhances the rapid speed modification capability of the invention.

The speed of switched reluctance motors is controlled by changing the frequency of energizing and de-energizing the windings of the motor to create a rotating magnetic field. Thus, a switched reluctance motor may be programmed to rotate the drive shaft in either direction and to slow down, stop or start very quickly, thereby providing the rapid change in pump speed in a matter of seconds that is desired in some applications. Because of both mechanical and electrical design factors, switched reluctance motors can achieve greater speeds than a standard induction motor.

These advantages and others are more clearly realized from the following detailed description of the invention.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
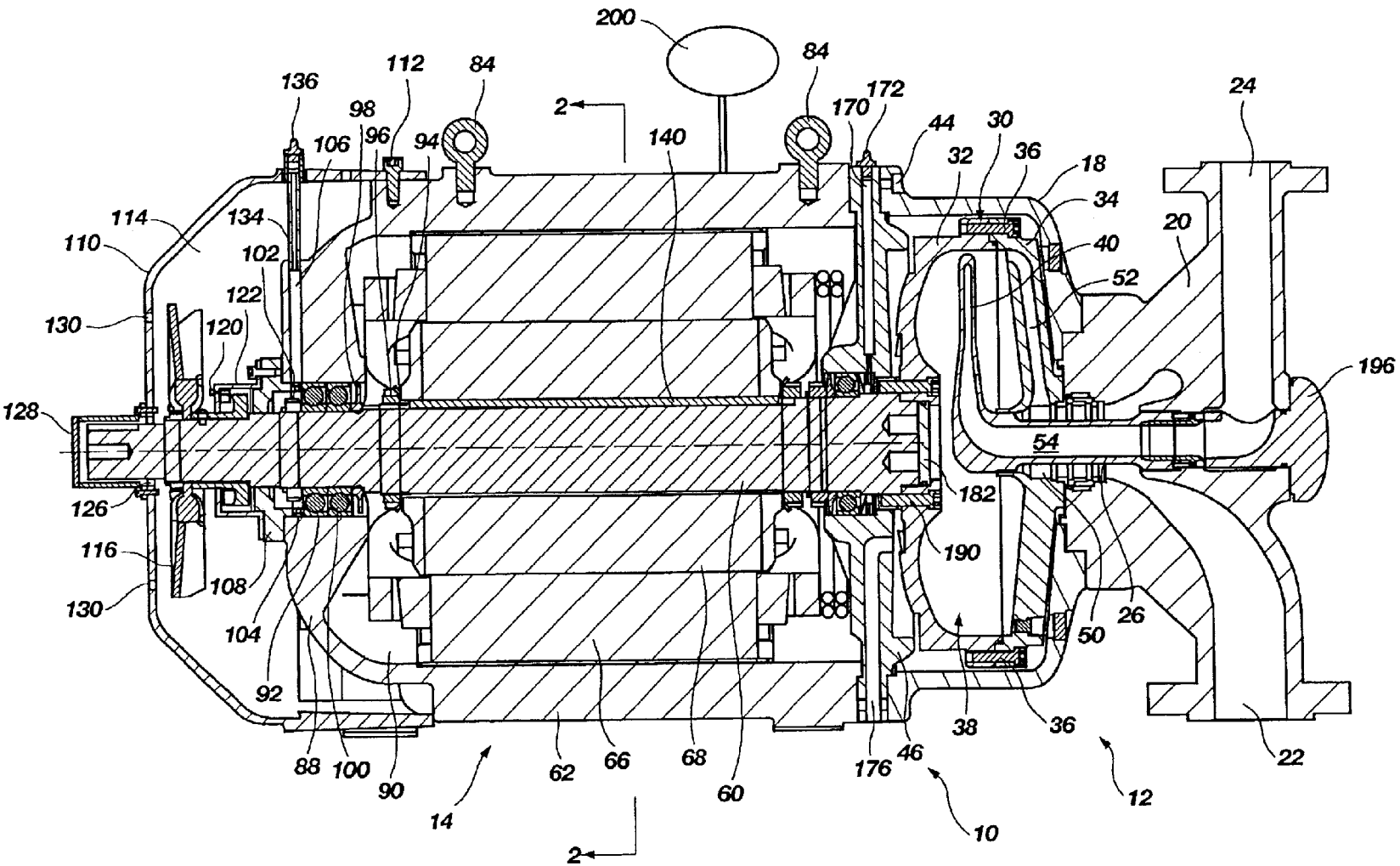
FIG. 1 is a view in longitudinal cross section illustrating the combined pump and motor configuration of the present invention.

The pump assembly 10 of the present invention, as shown in FIG. 1, generally comprises a centrifugal pump, here shown as being of the pitot tube type 12, directly coupled to a switched reluctance motor 14 which is configured to fit with and support the pump 12, as described further hereinafter.

The pump 12 is generally comprised of a pump housing 18 to which is secured a pump manifold 20. The pump manifold 20 is structured to provide a pump inlet 22 and a pump outlet 24. The pump manifold 20 also houses a portion of the stationary pitot tube assembly 26 which extends axially through the pump 12.

The pump 12 further comprises a rotating assembly 30 comprising a pump rotor 32 and rotor cover 34 which is attached to the pump rotor 32 by suitable attachment members 36. Pump rotor 32 and rotor cover 34 form an internal rotor chamber 38 in which is positioned the stationary pick up tube 40 of the pitot tube assembly 26. In the present invention, the pump housing 18 is secured by appropriate securement members 44 to an end plate 46. The end plate 46 is in turn connected to the motor 14, as described more fully hereinafter.

In operation, fluid to be pumped enters the pump inlet 22 and is conveyed through an annulus 50 surrounding the pitot tube assembly 26 to radial passages 52 formed in the rotor cover 34. Fluid exits the rotor cover 34 into the chamber 38 where the rotation of the rotating assembly 30 forces the fluid to the peripheral regions of the chamber 38. The fluid is then forced into the pick up tube 40 where the fluid moves through the conduit 54 of the pitot tube assembly 26 to the pump outlet 24. It should be noted that the configuration of the pitot tube pump 12 illustrated in FIG. 1 is by way of example only and the pitot tube pump 12 may vary widely in its design and configuration.

In the present invention, the pitot tube pump 12 is configured to be coupled directly to the motor 14. Specifically, the rotating assembly 30 is attached to the drive shaft 60 of the motor 14 and the end plate 46 to which the pump housing 18 is attached is further attached to the motor housing 62. As previously noted, the direct coupling of a pitot tube pump to a conventional induction motor imposes severe operational limitations. The ability to select the size and dimension of the drive shaft 62 to accommodate the larger mass and inertia of the rotating assembly 30 of a pitot tube pump, coupled with the operational characteristics of certain motor types, makes it possible to attach the pump 12 directly to the motor 14 and achieve improved pumping characteristic, such as on-demand and rapid changes in pump speed in pitot tube pumps.

The motor 14 of the present invention can be structured to provide significant changes in pump speed in a matter of a few seconds. While other motors may be equally suitable, a preferred motor for use in the present invention is a switched reluctance motor because it is capable of being programmed to reduce pump speeds from 100% to 10% of capacity or less, and to increase pitot tube pump speeds from zero percent to about 80% of capacity, or greater, in a matter of a few seconds (i.e., between five to ten seconds). The unique construction of the switched reluctance motor rotor also makes it possible to modify the dimensions of the drive shaft to accommodate the larger mass and inertia characteristics of a pitot tube pump.

Figure 2:
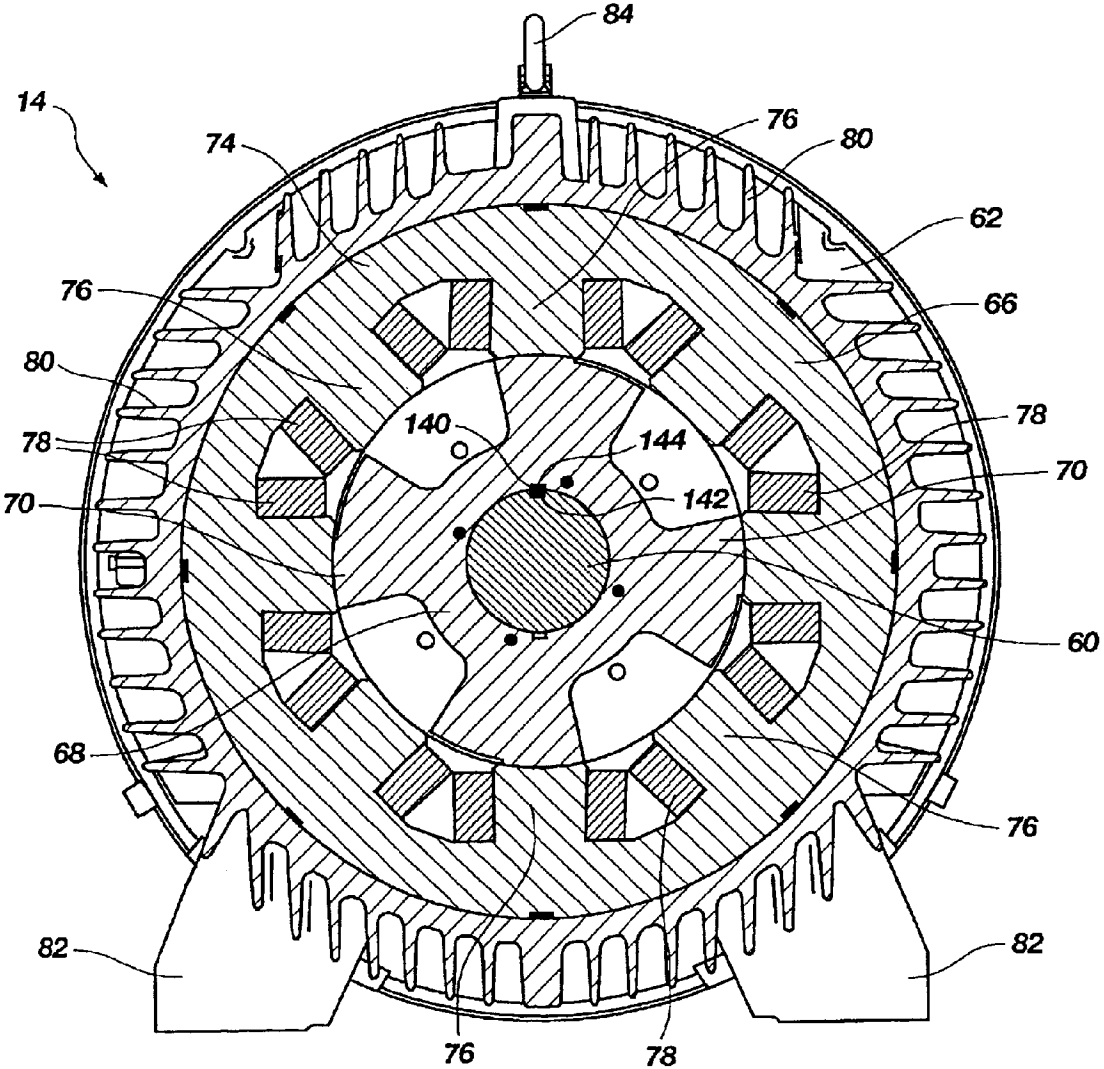
FIG. 2 is a view in lateral cross section taken through line 2—2 of FIG. 1.

The motor 14 generally comprises a motor housing 62 in which is positioned a stator 66 and rotor 68 which operates to rotate the drive shaft 60. FIG. 2 more clearly illustrates the elements of the motor 14. It can be seen that the rotor 68 is fixedly attached to the drive shaft 60 as described further hereinafter. In this particular embodiment of a switched reluctance motor, the rotor 68 is formed with four poles 70 that extend radially outwardly from the center of the rotor 68 and extend longitudinally along the length of the rotor 68. The stator 66 is generally comprised of a cylindrical body 74 that surrounds the rotor 68. The stator 66 is configured with elongated stator poles 76 that extend radially inwardly from the cylindrical body 74 of the stator 66 and are co-extensive in length with the length of the cylindrical body 74. As is typical of switched reluctance motors, there are more stator poles 76 than rotor poles 70. Moreover, each stator pole 76 is diametrically positioned opposite another stator pole 76.

Around the longitudinal length of each stator pole 76 is wound a quantity of wire, which is referred to as the windings 78 of the motor. In switched reluctance motors, it is the selective ability to energize certain diametrically opposed pairs of stator poles 76, in seriatim which sets up an electromagnetic field, thereby causing the rotor, and thus the drive shaft 60, to rotate. It is also that ability to selectively energize and de-energize the stator poles 76 in a rapid manner which makes switched reluctance motors ideal for rapidly increasing or decreasing the rotation of the drive shaft, and thus the rotational speed of the pump.

The motor housing 62, as illustrated in FIG. 2, may be configured with structural fins 80 that help direct cooling fluid (e.g., cooled air), down the length of the motor 14 to reduce high heat conditions during operation of the motor 14. The motor housing 62 may be structured with support members 82 which allow the motor 14 to be stable positioned on a base or other support surface. The motor housing 62 may also be structured with grip eyes 84 to allow the pump 10 of the invention to be lifted into and out of a particular setting.

Referring again to FIG. 1, it can be seen that the motor housing 62 is configured with an end face 88 that, in conjunction with the end plate 46, provides the interior space 90 of the motor housing 62 in which the rotor 68 and stator 66 are positioned. An opening 92 is formed through the end face 88 of the motor housing 62 to provide extension of the drive shaft 60 there through. A lock washer 94 and lock nut 96 are spun down on the drive shaft 60 in assembly of the motor 14 to secure the drive shaft 60 to the rotor 68.

A lubrication retainer 98 is positioned in the opening 92 of the motor housing 62 and is positioned adjacent a series of rear angular contact bearings 100 that center the drive shaft 60 in the opening 92. A self-locking nut 102 is spun down on the drive shaft 60 and positioned adjacent the rear angular contact bearings 100 to secure them in position. A lubrication distribution ring 104 may also be positioned in the opening 92 adjacent the rear angular contact bearings 100. The lubrication distribution ring 104 is structured to permit lubricant to enter into the opening 92 in the motor housing 62 to lubricate the rear angular contact bearings 100. The lubricant is introduced through a channel 106 formed in the end face 88 of the motor housing 62. A cap 108 is then positioned about the drive shaft 60 and is positioned adjacent to the opening 92 in the end face 88 of the motor housing 62 to stabilize the drive shaft 60.

The present invention further includes means for cooling the motor 14 during operation. Therefore, as shown in the illustrated embodiment of FIG. 1, a cooling cover, more properly designated here as a fan cover 110, is secured by appropriate securement elements 112 to the motor housing 62. The fan cover 110 provides a cooling chamber 114 in which a cooling fluid may be produced or introduced to cool the motor 14, particularly the rear bearings of the motor 14.

In this particular embodiment, the drive shaft 60 is configured in length and dimension to extend beyond the end face 88 of the motor housing 62 to accommodate the placement of a fan member 116 about the drive shaft 60. The extended length of the drive shaft 60 also accommodates, in this embodiment, a sensor 120, which is in turn connected to a sensor housing 122, which is positioned adjacent and connected to cap 108. The sensor 120 facilitates the ability of the motor 14 to rapidly increase and decrease rotational speed by detecting the position of the rotor poles 70 relative to the stator poles 76 in the moving magnetic field that is produced there between.

The drive shaft 60 in the illustrated embodiment extends through an opening 126 in the fan cover 110 and the terminal end of the drive shaft 60 is enclosed in an end cap 128 that is secured to the fan cover 110. The fan cover 110 is structured with a plurality of vents 130 which allow cooling air to be drawn into the cooling chamber 114. The cooling air drawn into the cooling chamber 114 then travels down the fins 80 to cool the motor 14. It should also be noted that when a fan cover 110 is employed in the present invention, a channel extender 134 may be required to extend from the lubrication channel 106 to introduce lubricant to the rear bearings. The channel extender 134 is preferably provided with a cap 136 to maintain a closed environment for the lubricant.

While it is illustrated in FIG. 1 that a fan may be used as a means of cooling the motor 14, it is equally as suitable to employ an alternative means of cooling the motor 14, including providing means for circulating water or another liquid cooling agent about the motor 14, and the present invention is not intended to be limited to the use of a fan as illustrated.

Figure 3:
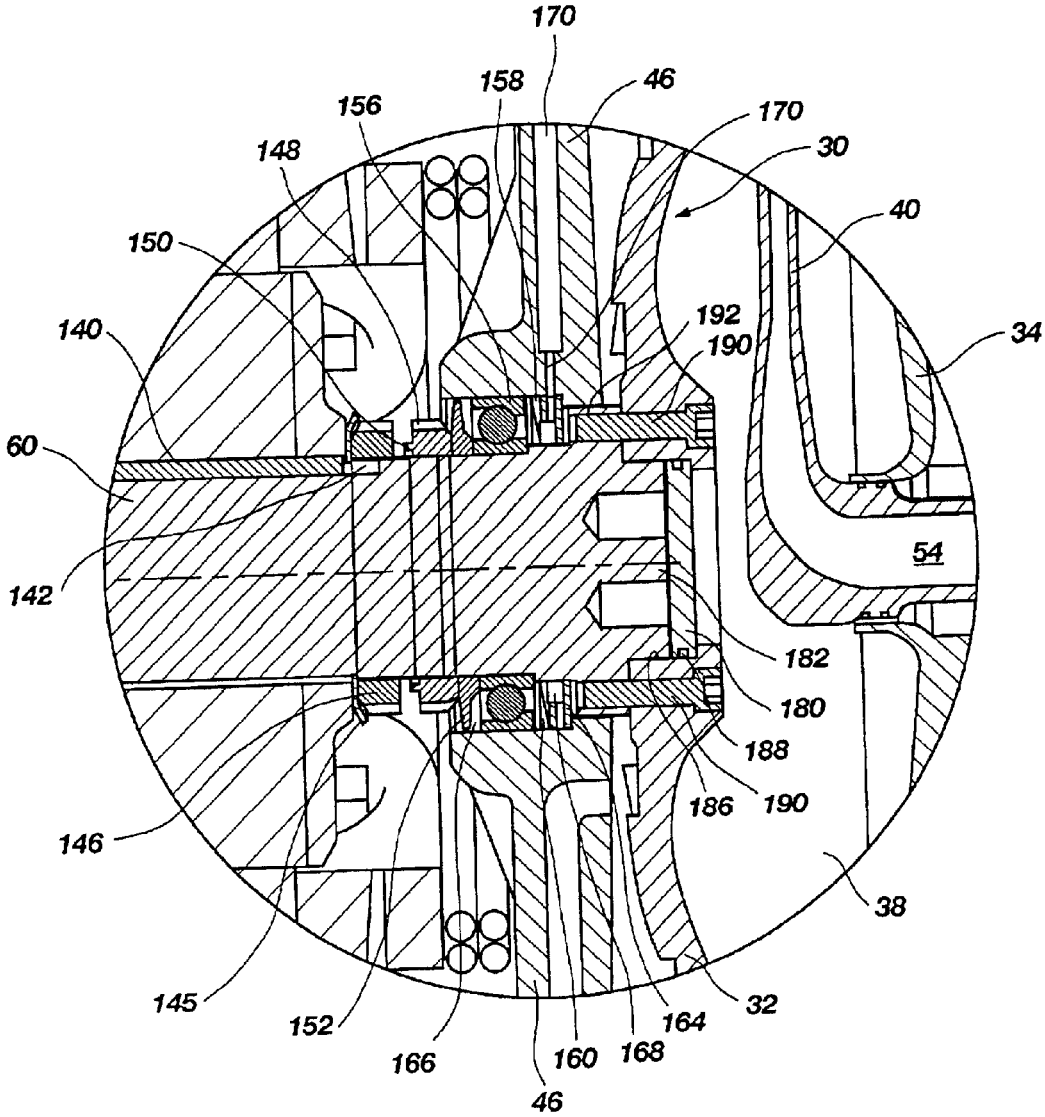
FIG. 3 is an enlarged view showing the attachment of the rotating assembly to the drive shaft of the motor.

It can be seen by reference to FIGS. 2 and 3 that a spline 140 is positioned in a longitudinal groove 142 (FIG. 2) formed along the length of the drive shaft 60, and in a similar longitudinal groove 144 formed along the length of the rotor 68, to key the drive shaft 60 to the rotor 68.

FIG. 3 illustrates an enlarged view of the attachment of the rotating assembly 30 of the pump 12 to the drive shaft 60. A lock washer 145 and locking nut 146 are spun down on the drive shaft 60 to secure the drive shaft 60 to the motor rotor 68. Moreover, the lock washer 94 and lock nut 96 (FIG. 1) at the rear of the drive shaft 60, in concert with lock washer 145 and locking nut 146, provide axial stability to the drive shaft 60 and rotor 68.

A self-locking nut 148 is secured on the drive shaft 60 in proximity to locking nut 146. A plastic ring 150 is associated with the self-locking nut 148 to lock the nut 148 to the drive shaft 60. A lubrication retainer 152 is positioned about the drive shaft 60 adjacent to the self-locking nut 148. A forward ball bearing 156 is positioned about the drive shaft 60 adjacent the lubrication retainer 152. A bearing shim 158 is next positioned about the drive shaft 60 followed by a wave spring 160 positioned adjacent the bearing shim 158. A lubrication distributor ring 164 is next positioned adjacent the wave spring 160.

The end plate 46 is then positioned about the drive shaft 60. The end plate 46 is formed with a centrally-located shouldered opening 166 the internal diameter of which is sized to accommodate the lubrication retainer 152, forward ball bearing 156, bearing shim 158, wave spring 160 and lubrication distributor ring 164. An annular space 168 is formed between the bearing shim 158 and lubrication distributor ring 164. As best shown in FIG. 1, the end plate is formed with a lubrication channel 170 which is in fluid communication with the annular space 168. Lubricating material is provided to the forward spindle bearing 156 via the lubrication channel 170 and annular space 168. A lubrication channel cap 172 (FIG. 1) is preferably provided to maintain a closed environment for the lubricant.

The end plate 46 may also be preferably formed with a channel 176 through which air can enter and exit the pump housing 18 to cool the rotating assembly 30.

With the end plate 46 positioned in place against the motor housing 62, a pump rotor plug 180 is positioned against the terminal end 182 of the drive shaft 60. The pump rotor 32 is then positioned over the terminal end 182 of the drive shaft 60, and adjacent the end plate 46. The pump rotor 32 is formed with a centrally-located opening 186, best seen in FIG. 3, the internal diameter of which is sized to receive the terminal end 182 of the drive shaft 60. An o-ring 188 surrounding the pump rotor plug 180 seals the drive shaft 60 from the pump rotor chamber 38.

The pump rotor 32 is secured by suitable securement members 190 (e.g., bolts) to a flanged portion 192 of the drive shaft 60. The rotor cover 34 is then attached to pump rotor 32 as previously described, the pitot tube assembly 26 is positioned in the rotor cover 34 and the pump housing 18 is secured to the end plate 46 (FIG. 1) by suitable securement members 44. Finally, the pitot tube assembly 26 is attached to the pump manifold 20 and the pump manifold 20 is then secured to the pump housing 18. A manifold plug 196 is inserted in the pump manifold 20 of the particular illustrated embodiment.

It should be noted that the switched reluctance motor 14 illustrated in FIG. 1 also has power and operational control mechanisms, typically located in proximity to the motor 14, which are shown only representational at 200 in the illustrated embodiments. Such power and operational control mechanisms are well known in the art and do not form a part of the invention herein. Therefore, no detail as to the particular mechanism is provided herein.

A particular feature of the present invention is the ability to select an appropriate sized drive shaft to accommodate the larger mass and inertia characteristics of pitot tube pump rotating assemblies. Because of its means of operation, a switched reluctance motor is, at present, the preferred type of motor that will allow the selection of a drive shaft to suit the requirements of the pump's rotating assembly. Of additional importance is the fact that the mode of operation of a switched reluctance motor allows the rotating assembly of a pitot tube pump, despite its larger mass and inertia, to be rapidly decreased in rotational speed (e.g., from 5,500 rpm to 1,000 rpm) in a matter of three to six seconds. Likewise, a switched reluctance motor allows the rotational speed to be rapidly increased (e.g., from zero rpm to 5,000 rpm) in a matter of five to ten seconds. Heretofore, such selective and rapid modification of pump speed in a pitot tube pump has been economically unachievably.

An additional notable feature of the present invention is the ability to significantly reduce the footprint of the pump/motor arrangement by virtue of the ability to eliminate the need for a gearbox intermediary to the motor and pump. The reduced footprint of the present invention further renders the invention more economical to manufacture and more widely usable than conventional pitot tube pumps and some centrifugal pump assemblies.

While the foregoing advantages of the present invention are manifested in the illustrated embodiments of the invention, a variety of changes can be made to the configuration, design and construction of the invention while preserving those advantages. Additionally, while the disclosure herein has focused on the combination of a switched reluctance motor and a pitot tube pump to achieve rapid modification of the pump speed, similar significant advantages in pump operation and operational economy are achieved by associating a switched reluctance motor with a high-speed centrifugal pump. Hence, reference herein to specific details of the structure and function of the present invention is by way of example only and not by way of limitation.

What is claimed is:

1. A pump assembly, comprising:

a motor housing;

a switched reluctance motor positioned within said motor housing, said switched reluctance motor having a stator and a motor rotor coaxially aligned with and positioned within said stator to be rotated thereby in a manner to provide rapid rotation modification of said motor rotor;

a drive shaft secured to said motor rotor;

a pump rotor coaxially aligned with said drive shaft and secured for rotation by said drive shaft;

at least one bearing assembly positioned to support said pump rotor and said motor; and a rotor cover secured to said pump rotor.

2. The pump assembly of claim 1 further comprising an end plate secured to said motor housing, and further comprising a pump housing secured to said end plate, said pump rotor and said rotor cover being housed within said pump housing.

3. The pump assembly of claim 1 further comprising a pitot tube assembly.

4. The pump assembly of claim 1 wherein said pump rotor and said rotor cover comprise part of a pump rotating assembly having a rotating weight of 50 pounds or greater and a rotating inertia of 5 pounds-foot$^2$ or greater.

5. The pump assembly of claim 1 wherein said motor is capable of reducing the rotational speed of said pump rotor and rotor cover from 100% to 10% or less in from about three to six seconds.

6. The pump assembly of claim 1 wherein said motor is capable of increasing the rotational speed of said pump rotor and rotor cover from about zero percent to about 80% or more in from about five to ten seconds.

7. The pump assembly of claim 1 further comprising a cooling mechanism to reduce the ambient temperature of at least a portion of said motor.

8. The pump assembly of claim 7 wherein said cooling mechanism is a fan attached to a terminal end of said drive shaft.

9. The pump assembly of claim 1 wherein said pump rotor and said rotor cover comprise a rotating assembly having a rotating weight at least twice that of an impeller pump having comparable pumping capacity.

10. A pump assembly comprising:

a centrifugal pump having a rotating assembly the rotating weight of which is at least 50 pounds and the rotating inertia of which is five pounds-foot$^2$ or greater;

a switched reluctance motor having a drive shaft attached directly to said rotating assembly and being structured with selectively controlled rotor an stator elements to provide rapid modification in the rotational speed of said rotating assembly.

11. The pump of claim 10 wherein said motor is capable of reducing the rotational speed of said rotating assembly from 100% 10% or less in from about three to six seconds.

12. The pump of claim 10 wherein said motor is capable of increasing the rotational speed of said rotating assembly from about zero percent to about 80% or more in from about five to ten seconds.

13. A pump having rapid speed modification capabilities, comprising:

a pump housing;

a large mass rotating assembly comprising a pump rotor and rotor cover positioned within said pump housing;

a motor housing;

a stator positioned within said motor housing;

a motor rotor positioned proximate said stator;

a drive shaft connected to said motor rotor for rotation thereby, said drive shaft having a terminal end connected to said pump rotor;

at least one bearing assembly positioned to support said large mass rotating assembly and said motor; and a control mechanism in electrical communication with said stator programmable to selectively produce rotation of said motor rotor to provide rapid modification of rotation of said pump rotor.

14. The pump of claim 13 further comprising a pitot tube assembly positioned at least in part within said large mass rotating assembly.

15. The pump of claim 13 further comprising a cooling mechanism to reduce the ambient temperature of at least a portion of said motor.

16. The pump of claim 15 wherein said cooling mechanism is a fan attached to a terminal end of said drive shaft.

17. The pump of claim 13 further comprising an end plate to which is connected said motor housing and said pump housing.

18. The pump of claim 13 wherein said large mass rotating assembly has a rotating weight at least twice that of an impeller pump having comparable pumping capacity.

19. The pump of claim 13 where said large mass rotating assembly has a rotating inertia that is at least one order of magnitude greater than an impeller pump having comparable pumping capacity.

20. The pump of claim 13 wherein said large mass rotating assembly has a rotating weight which is at least 135 pounds and a rotating inertia which is at least fifteen pounds-foot$^2$.

* * * * *